US005617080A

United States Patent [19]

Morich

[11] Patent Number: 5,617,080

[45] Date of Patent: Apr. 1, 1997

[54] COVERT LIGHT INDICATOR

[75] Inventor: Robert S. Morich, Crystal Lake, Ill.

[73] Assignee: Electrodynamics, Inc., Rolling Meadows, Ill.

[21] Appl. No.: 320,727

[22] Filed: Oct. 11, 1994

[51] Int. Cl.[6] ..... G08B 5/36

[52] U.S. Cl. ..... 340/815.57; 340/815.75

[58] Field of Search ..... 340/815.55–815.57, 340/815.73–815.77; 359/501, 601; 362/19

[56] References Cited

U.S. PATENT DOCUMENTS

| | | | |
|---|---|---|---|
| H1,154 | 3/1993 | Gibson et al. | 359/501 |
| 3,679,290 | 7/1972 | Adams et al. . | |
| 4,515,442 | 5/1985 | Aron | 350/397 |
| 4,580,196 | 4/1986 | Task | 362/62 |
| 4,677,533 | 6/1987 | McDermott | 362/240 |
| 4,697,890 | 10/1987 | Crookston | 350/407 |
| 4,947,291 | 8/1990 | McDermott | 362/19 |
| 4,963,798 | 10/1990 | McDermott | 315/312 |
| 5,150,257 | 9/1992 | Mohabbatizadeh et al. | 359/601 |
| 5,161,879 | 11/1992 | McDermott | 362/206 |
| 5,268,788 | 12/1993 | Fox et al. | 359/490 |

FOREIGN PATENT DOCUMENTS

0348141A1 12/1989 European Pat. Off. .

*Primary Examiner*—Jeffery Brier
*Attorney, Agent, or Firm*—Pennie & Edmonds

[57] ABSTRACT

A dimmable, infrared secure, indicator for use in equipment panel displays capable of maintaining sufficient luminance for proper equipment operation by personnel in covert situations, while minimizing detection by hostile entities is realized by a device comprising an light source, an infrared absorbing filter, and two polarizers. These components are incorporated into an external housing which includes a selectively rotatable segment capable of rotating one of the polarizers from a fully parallel to fully crossed position with respect to the other and a hood which minimizes the viewing angle of the indicator.

20 Claims, 8 Drawing Sheets

COVERT LIGHT INDICATOR

TECHNICAL FIELD

The present invention relates to a light indicator for use in equipment panel displays, and more particularly, a light indicator designed to minimize the possibility of its detection by hostile entities when used in covert situations.

BACKGROUND OF THE INVENTION

As never before, military, security, and law enforcement personnel employ sophisticated electronic equipment in the performance of their assigned tasks. Such equipment often incorporates a wide variety of panel displays and light indicators which serve to inform the user of system status or alert the user to dangerous conditions.

The use of such equipment, however, can pose serious problems when used by personnel operating in covert situations. Although the equipment may be necessary to accomplish the task at hand, the visible light radiation emitted from such panel light indicators may unfortunately be detected by hostile entities operating in or near the same area.

The problem is further magnified by the modern development of Generation III image intensifying devices, the most common of which is the night-vision goggle (NVG). Such devices permit an individual to see near-infrared and infrared radiation as visible light. Usually, equipment panel light indicators include incandescent lamps or light-emitting diodes (LEDs) which typically emit, in addition to visible light, some radiation in the near-infrared and infrared wavelength spectrum. Hostile forces equipped with night-vision goggles (NVGs) or similar equipment can easily detect equipment employing such light indicators.

Therefore, there is a need for light indicators which provide "secure" or night-vision compatible lighting. Secure lighting is defined as lighting that provides the operator with necessary system information, yet is not substantially visible to an aggressor using either an unaided eye or an image intensifying device.

Prior art panel light indicators cannot satisfactorily meet this "secure" requirement. Although the conventional wisdom has been to use shutter caps placed over the light indicators to selectively block the radiation, such a solution does not permit the user to be continuously apprised of necessary system information. Disadvantageously, the light indicator becomes fully detectable when the user opens the shutter to check a system parameter.

SUMMARY OF THE INVENTION

Therefore, an object of the present invention is to provide a light indicator for use in equipment panel displays which can continuously apprise the equipment user of necessary system information, while not being visible to a hostile entity using a naked eye or an image intensifying device.

A further object of the present invention is to provide a light indicator in which emissions of non-essential infrared and near-infrared radiation have been substantially eliminated.

Another object of the present invention is to provide a light indicator capable of being selectively dimmed by an operator in a continuous variable fashion from a full brightness level to a level where emitted radiation has been substantially eliminated.

Yet another object of the present invention is to provide a light indicator with a restricted viewing angle such that light radiation from the device is only visible from positions substantially along its longitudinal axis.

A still further object of the present invention is to provide a light indicator having the capability of significantly reducing specular reflections from both internal optics and external light sources.

These and other objects are achieved by a dimmable, infrared secure, light indicator comprising a light source, an infrared absorbing filter, and rotatable polarizers encased within a compact housing. In one preferred embodiment the light source is a light-emitting diode. The housing includes a selectively rotatable segment whereby the user can rotate one of the polarizers from a fully parallel to fully crossed position with respect to the other and a hood which substantially restricts the viewing angle of the light indicator.

Advantageously, this unique and novel arrangement provides a light indicator which retains sufficient luminance for proper equipment operation, while minimizing the possibility of detection by hostile entities using Generation III image intensifier night vision devices or an unaided eye.

In accordance with one aspect of the invention, wavelength restriction is employed to substantially eliminate non-essential infrared and visible light radiation. The infrared absorbing filter accomplishes this task by substantially limiting the transmission of near-infrared and infrared radiation from the light indicator.

In accordance with another aspect of the invention, two polarizing filters are incorporated in such a manner whereby one can be rotated in relation to the other. In one preferred embodiment of this invention, two circular polarizers are employed with their linear sides facing each other. This combination allows the user, by rotating one of the polarizers from a fully parallel to a fully crossed position, to selectively reduce the intensity of the energy emitted from the indicator. The user achieves this rotation by turning the rotating segment of the external housing. In that manner, the intensity level can be set continuously from full brightness for daytime use to a fully off position where radiation from the indicator has been substantially eliminated.

In accordance with another aspect of the invention, the external housing incorporates a hood which restricts the viewing angle of the indicator. Because radiation from any light source diverges, an observer can see a light source without having to view it on axis. Restricting the viewing angle minimizes this type of detection threat. The hooded housing which forms the body of the indicator limits the viewing angle to, preferably, twenty degrees or less, thereby permitting the indicator to be viewed only from positions substantially along its longitudinal axis.

In accordance with another aspect of the invention, the light indicator further reduces detectability of the equipment by substantially reducing specular reflections. Reflections off the optical components of the light indicator might provide an additional avenue of detection by aggressors. This threat is minimized in two distinct manners. First, the infrared absorbing filter used for wavelength restriction is coated with an anti-reflective layer which reduces reflection to approximately one percent or less. Second, the use of circular, rather than typical linear, polarizers in the dimming mechanism reduces specular reflections off the internal optics of the light indicator.

BRIEF DESCRIPTION OF THE DRAWINGS

A more complete understanding of the invention may be obtained by reading the following description of illustrative embodiments of the invention in which like elements are labeled similarly and in which.

DETAILED DESCRIPTION OF THE INVENTION

Figure 3:
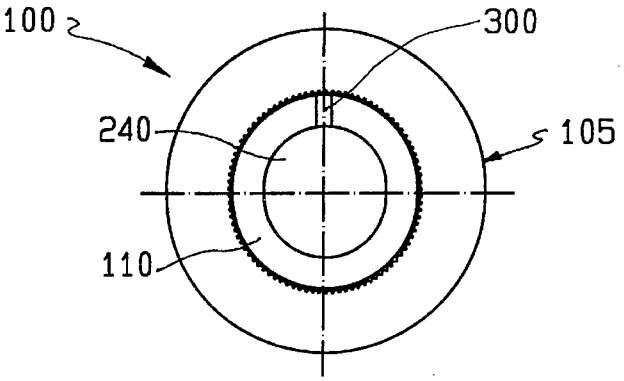
FIG. 3 is a front view of the light-indicator of FIG. 1.
Figure 1:
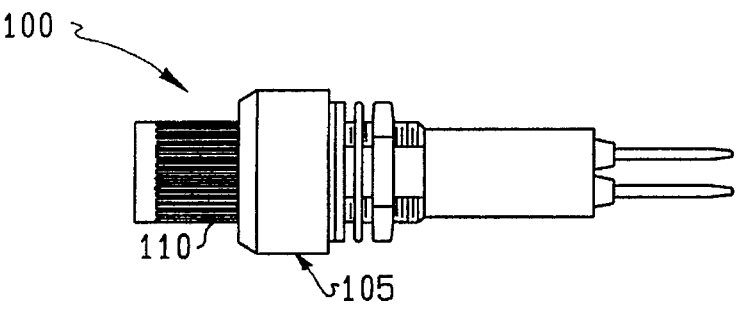
FIG. 1 is a side elevation view of a light indicator in accordance with the principles of the invention.
Figure 2:
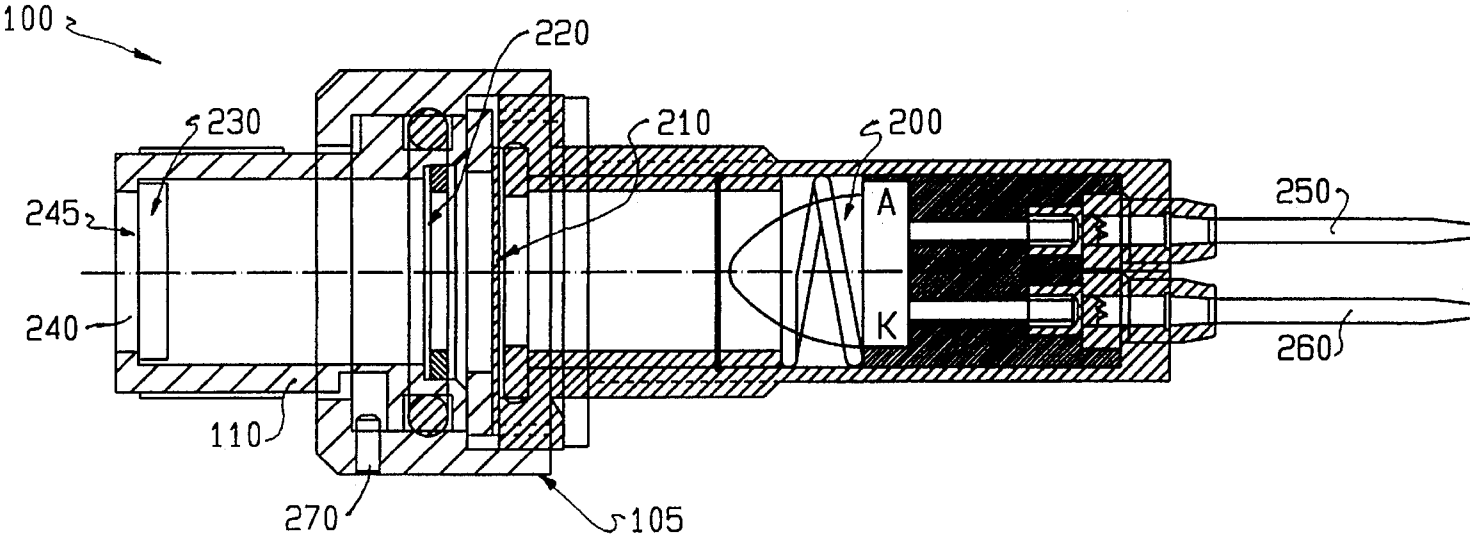
FIG. 2 is a longitudinal cross-sectional view of the light indicator of FIG. 1 showing the major internal subassemblies.

An exemplary embodiment of a light indicator 100 in accordance with the principles of the invention is shown in FIGS. 1–3. Light indicator 100 comprises, as shown in FIG. 2, a light source (here a light-emitting diode (LED)) 200, first polarizer 210, second polarizer 220, infrared absorbing filter 230, and external housing 105. Light indicator 100 also includes selectively rotatable segment 110. It should be understood that FIG. 3 specifically shows a front view of light indicator 100, looking into a viewing aperture 240.

Figure 4:
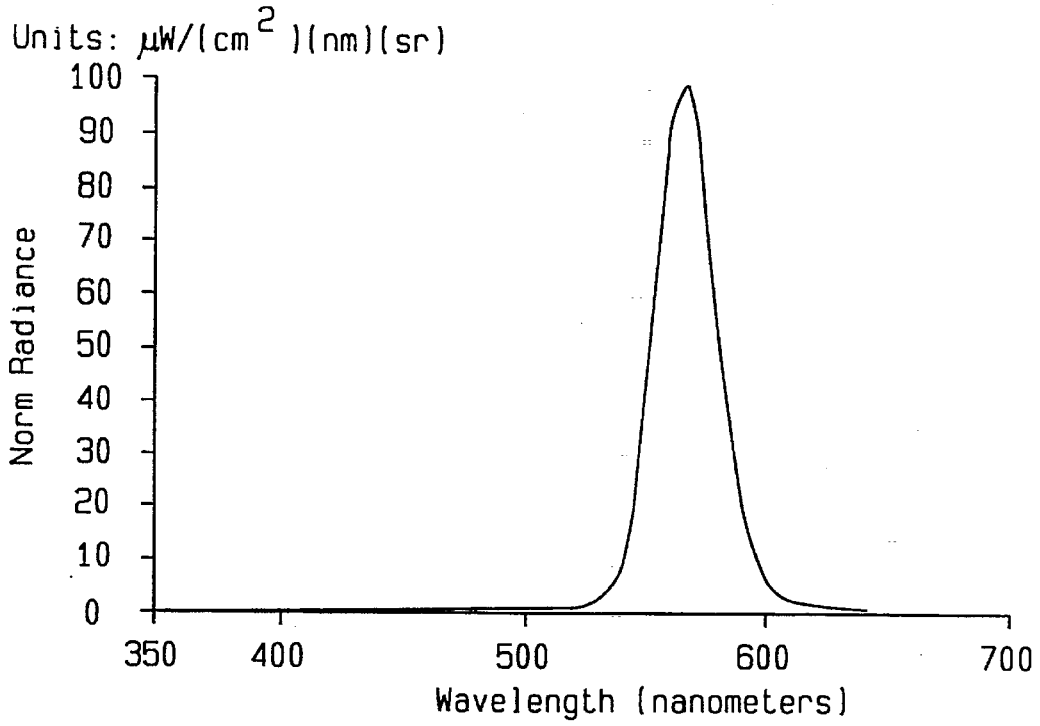
FIGS. 4–6 are normalized plots of the radiance output of unfiltered green, yellow and red LEDs, respectively, used in the light indicator of FIG. 1.
Figure 5:
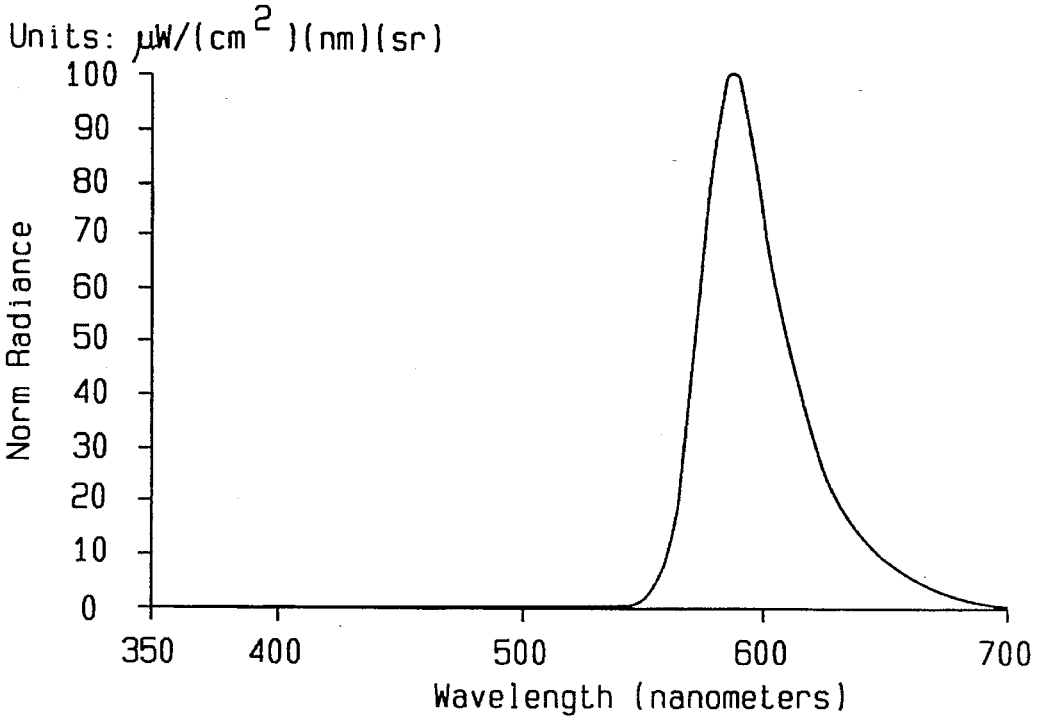
Figure 6:
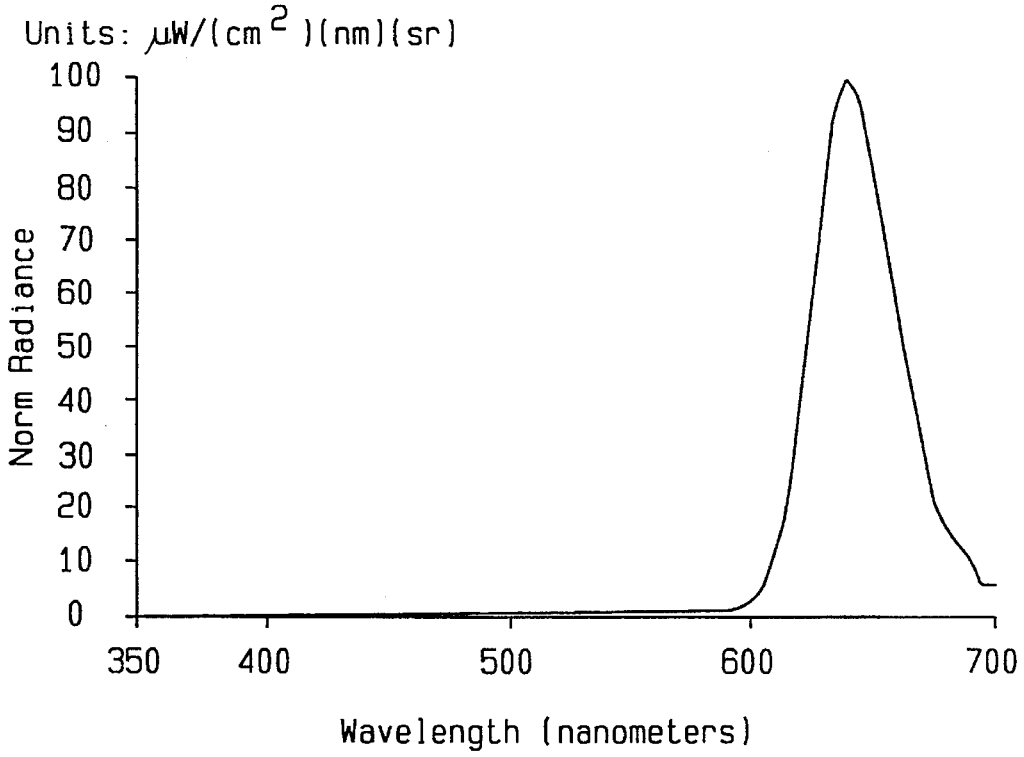

In this preferred embodiment, light radiation is generated by LED 200. Those skilled in the art will readily recognize that a wide variety of light-emitting devices may be selected. The color of LED 200 employed will be the base color for light indicator 100. Commercially available LEDs may be used, such as Model HLMP-3590 (green), HLMP-3490 (yellow), or HLMP-3390 (red) manufactured by Hewlett-Packard Corporation of Palo Alto, Calif. The types of electronic equipment in which light indicator 100 is intended to be installed will be capable of generating electrical signals corresponding to particular system status information. These signals are applied between the anode 250 and the cathode 260 of the LED 200. FIGS. 4–6 show typical normalized plots of the radiance output for green, yellow, and red LEDs, respectively.

Light radiation generated by LED 200 propagates to first polarizer 210. A commercially available circular polarizer is selected for both first polarizer 210 and second polarizer 220, preferably a high performance circular polarizer, such as the KNCP polarizer manufactured by Polaroid Corp. of Cambridge, Mass.

A circular polarizer consists of a linear polarizer layer bonded to a quarter-wave plate. See, *Photometry and Radiometry for Engineers* by Stimson, John Wiley & Sons, New York (1974). First polarizer 210 and second polarizer 220 are mounted within external housing 105 such that the linear polarizer portions are facing each other. Second polarizer 220 is mounted such that it rotates with respect to first polarizer 210 when the user turns selectively rotatable segment 110 of external housing 105.

A linear polarizer permits those components of the light radiation whose electric vectors vibrate parallel to the plane of polarization to pass through unhindered. For instance, a linear polarizer oriented so that the plane of polarization is vertical will only allow those components of the light radiation parallel to the vertical plane to pass. Those radiation components not parallel to the axis of polarization will be absorbed by the polarizer.

A mechanism for variable attenuation of light radiation is created by placing second polarizer 220 in the light path. Second polarizer 220 is substantially identical in characteristics to first polarizer 210. When the plane of polarization of both first polarizer 210 and second polarizer 220 is aligned substantially all light radiation passed by first polarizer 210 will be passed by second polarizer 220. As second polarizer 220 is rotated off the axis of polarization of first polarizer 210, only those components of the light radiation passing through first polarizer 210 which match the new plane of polarization of second polarizer 220 will propagate through. As the angle of rotation increases towards 90 degrees, fewer components of the light radiation passing through first polarizer 210 will be able to pass through second polarizer 220. Ultimately, when the angle of rotation is 90 degrees, the plane of polarization of second polarizer 220 will be perpendicular to that of first polarizer 210. At this point, the polarizers are said to be in a fully crossed position, a position in which substantially no light radiation is successfully passed through both polarizers.

FIG. 3 shows a front view of the exemplary embodiment of the present invention. The front of selectively rotatable segment 110 is marked by an indicator line 300 so that the user can visually determine the current rotational angle of second polarizer 220 with respect to first polarizer 210. As shown in FIG. 2, the rotational motion of selectively rotatable segment 110 is impeded by a stop pin 270, such that the maximum rotation is 90 degrees. In other words, the user can move from a fully parallel (maximum luminance) to a fully crossed (minimum luminance) position in a quarter-turn of selectively rotatable segment 110. In this manner the user can judicially select the proper amount of dimming to achieve secure lighting, that is, the proper amount of dimming such that the luminance of the indicator is sufficient to apprise the user of system information, but insufficient to permit detection by a hostile entity using an unaided eye. This exemplary embodiment of the present invention incorporates manual rotation of the selectively rotatable segment 110, but it is understood that such rotation may be automated.

Figure 7:
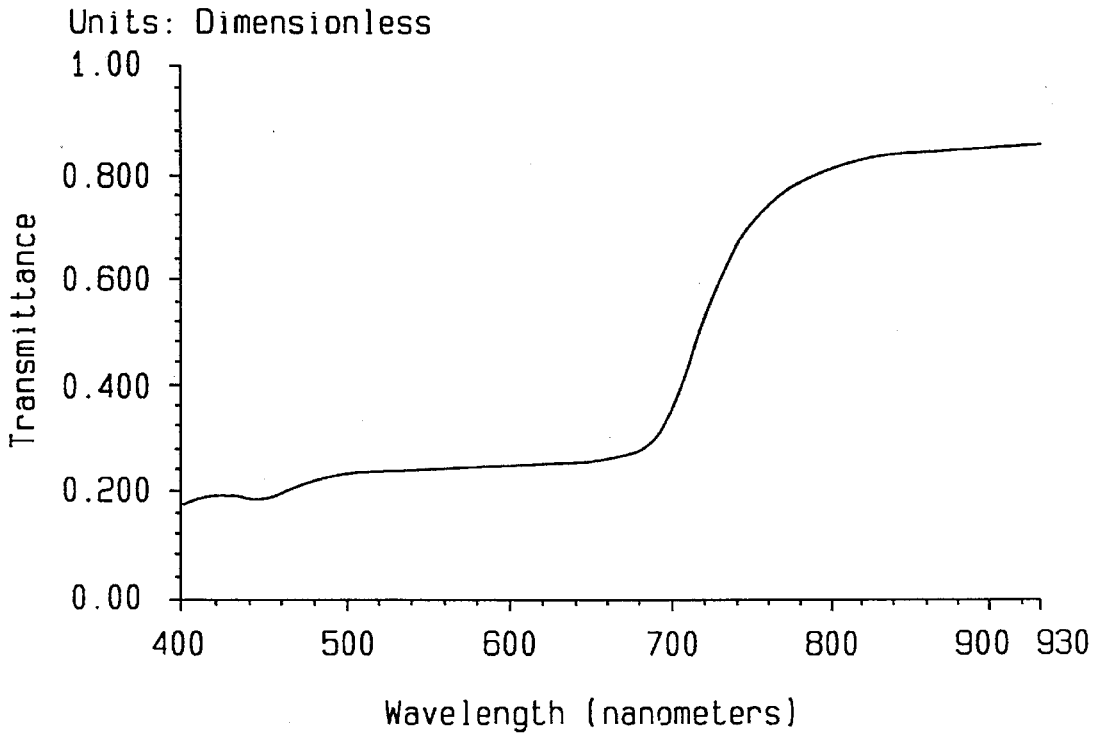
FIG. 7 is a transmission plot of the polarizer pair used in the light indicator of FIG. 1 when rotated into the fully parallel position.
Figure 8:
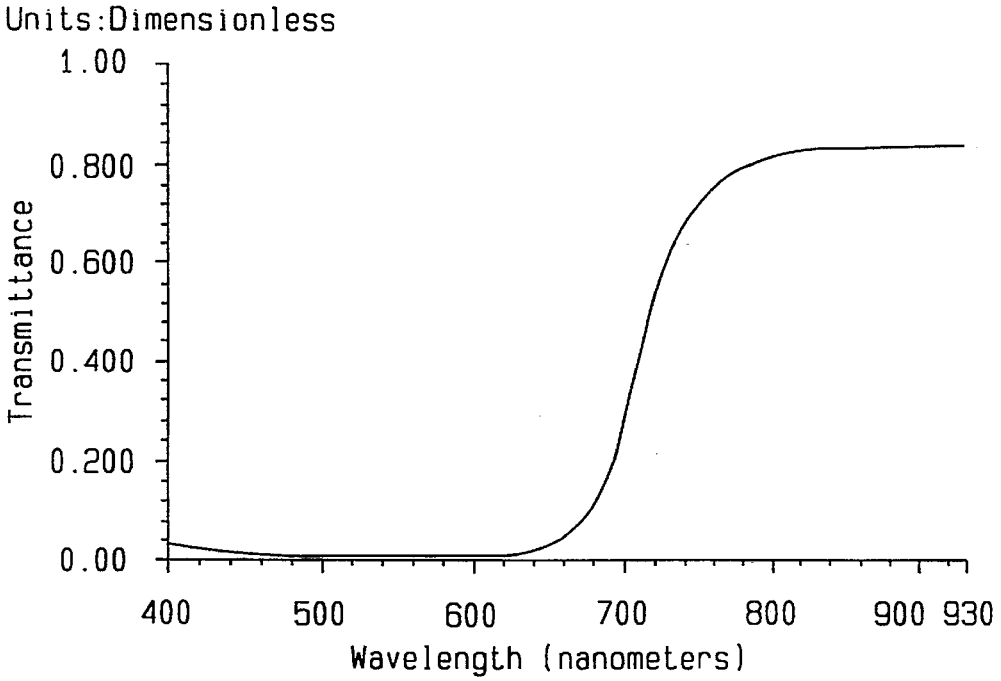
FIG. 8 is a transmission plot of the polarizer pair used in the light indicator of FIG. 1 when rotated into the fully crossed position.
Figure 9:
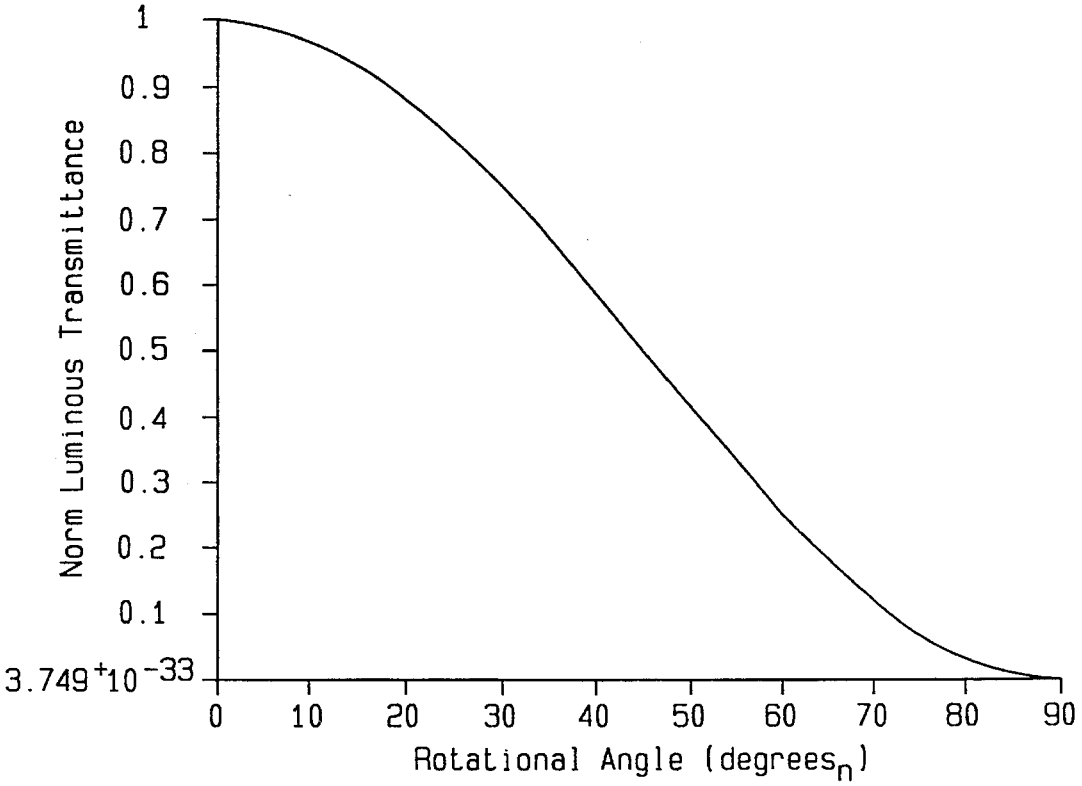
FIG. 9 is a normalized transmission plot of the polarizer pair used in the light indicator of FIG. 1 as a function of rotational angle.

FIGS. 7–9 graphically illustrate the operation of the polarizer pair. FIG. 7 shows a transmission plot of the polarizer pair when second polarizer 220 is rotated fully parallel to first polarizer 210. Likewise, FIG. 8 shows a transmission plot of the polarizer pair when second polarizer 220 is in a fully crossed position relative to first polarizer 210. FIG. 9 shows a typical normalized transmission plot of the polarizer pair as a function of the rotational angle of second polarizer 220 with respect to first polarizer 210.

The selection of circular polarizers, rather than standard linear polarizers, serves to reduce internal specular reflections. Specifically, the quarter-wave plate, which forms part of any circular polarizer, is a retardation element that changes the phase of the incident plane polarized light by one quarter wavelength. If the exitant light is reflected back from a specular surface, its phase will again be retarded one quarter wavelength by the quarter wave plate, so that it will then be one half wavelength out of phase with the linear polarizer and will not be transmitted. See, *Photometry and Radiometry for Engineers*, by Allen Stimson, John Wiley & Sons, New York (1974) and Optics, by Hecht and Zajac, Addision-Wesley Publishing, Reading, Mass. (1974). In this manner, internal reflections within the indicator arising from external light sources, will not be transmitted back out externally.

Figure 10:
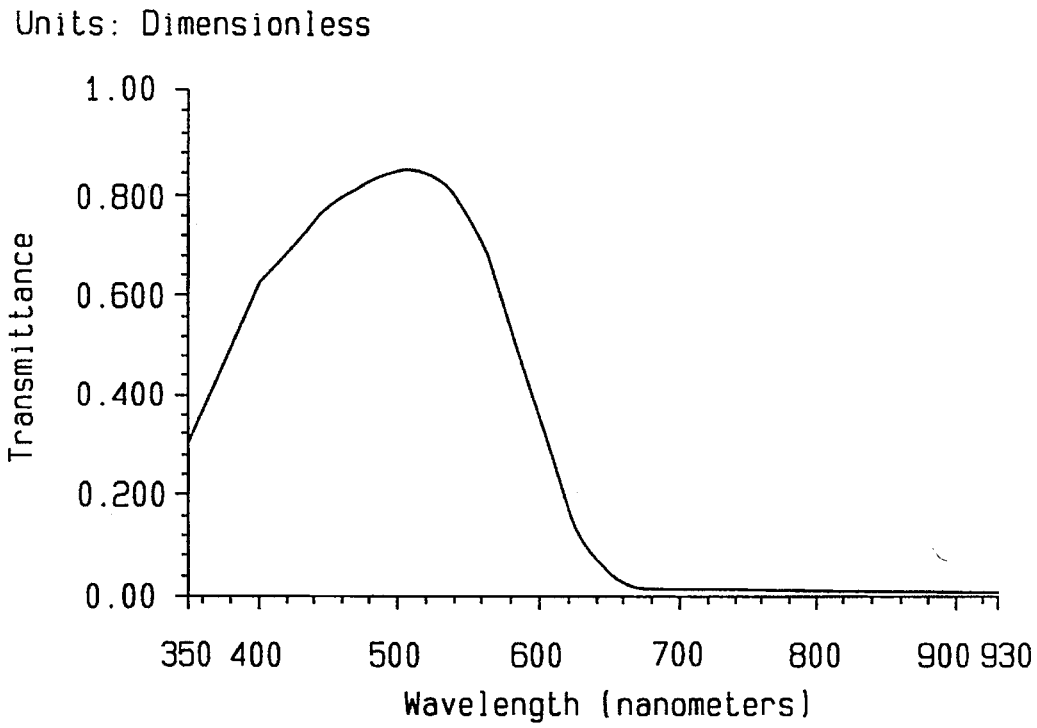
FIG. 10 is a transmission plot of the infrared absorbing filter used in the light indicator of FIG. 1.

The light radiation which is passed by second polarizer 220 is propagated to a commercially available infrared absorbing filter 230, such as the Hoya Optics CMC-500 glass filter manufactured by Hoya Corp. of San Jose, Calif. Infrared absorbing filter 230 is approximately 1 millimeter thick and is preferably coated with an anti-reflective layer 245 on the front exterior surface. The Hoya Optics MSL-554 glass may be used as an alternate for green or yellow LEDs 200, but is not appropriate for red LEDs because of its lower cutoff wavelength. FIG. 10 shows a typical transmission plot of infrared absorbing filter 230 at wavelengths from 350 nanometers to 930 nanometers.

Anti-reflective layer 245 on the front exterior surface of infrared absorbing filter 230 serves to reduce reflections from external light sources. For example, thin films of magnesium fluoride ($MgF_2$), zinc sulfide (ZnS), and the like may be used as anti-reflective layer 245. See *Modern Optical Engineering* by Smith, McGraw-Hill, New York (1966). At an angle of incidence of 0 degrees, the reflectance is a maximum of approximately 0.6%. At an angle of incidence of 30 degrees, the reflectance is a maximum of approximately 1.0%. This feature further reduces the detectability of the device.

Figure 11:
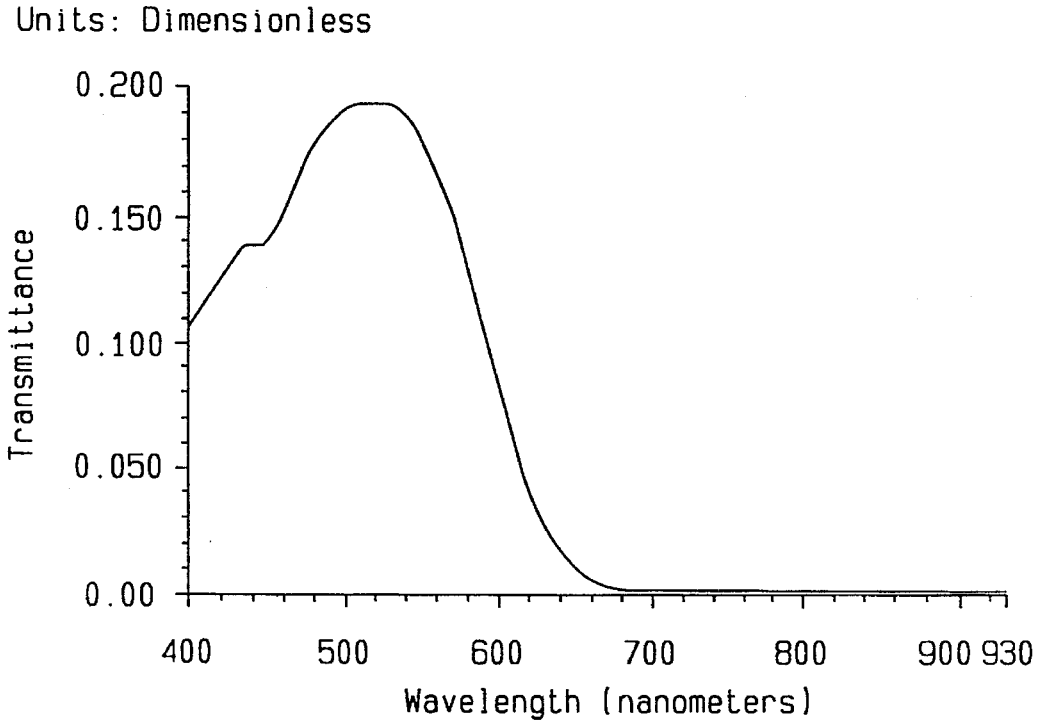
FIG. 11 is a transmission plot of the resultant system combination of the infrared absorbing filter and the polarizer pair used in the light indicator of FIG. 1 when the polarizer pair is rotated into the fully parallel position.
Figure 12:
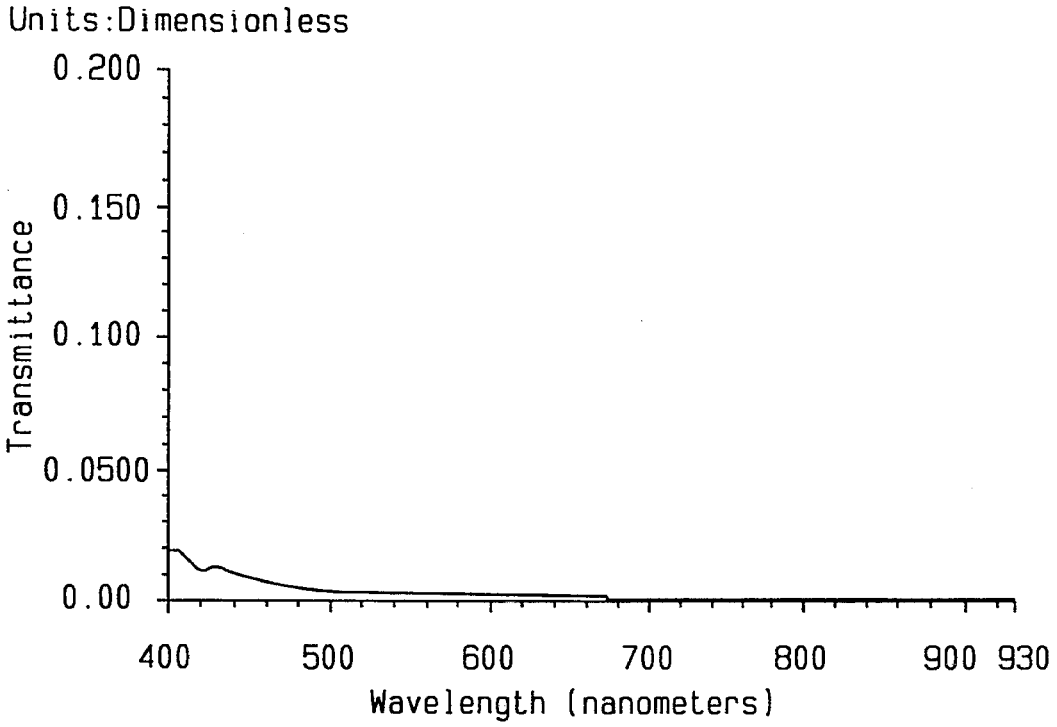
FIG. 12 is a transmission plot of the resultant system combination of the infrared absorbing filter and the polarizer pair used in the light indicator of FIG. 1 when the polarizer pair is rotated into the fully crossed position.

The combination of infrared absorbing filter 230 and the polarizer dimming mechanism simultaneously reduces the infrared signature of outgoing light radiation while permitting intensity reduction within the visible spectrum. FIGS. 11–12 show transmission plots of infrared absorbing filter 230 used in conjunction with the polarizer pair. FIG. 11 is a plot of the system transmittance through the filter and polarizers when the polarizers are in a fully parallel position, whereas FIG. 12 illustrates a transmission plot when the polarizers are in a fully crossed position. These graphs effectively illustrate how the present invention achieves secure lighting by eliminating near-infrared and infrared radiation and providing variable dimming within the visible wavelengths.

After passing through infrared absorbing filter 230, light radiation propagates through aperture 240 and out externally to the equipment user. External housing 105, including the selectively rotatable segment 110, acts as a hood which restricts the viewing angle. A user must, therefore, be in a position within approximately twenty degrees from the longitudinal axis of light indicator 100 in order to view the light radiation emitted therefrom. This reduces detectability of the indicator by eliminating the possibility of viewing by a hostile entity at an oblique position.

Figure 13:
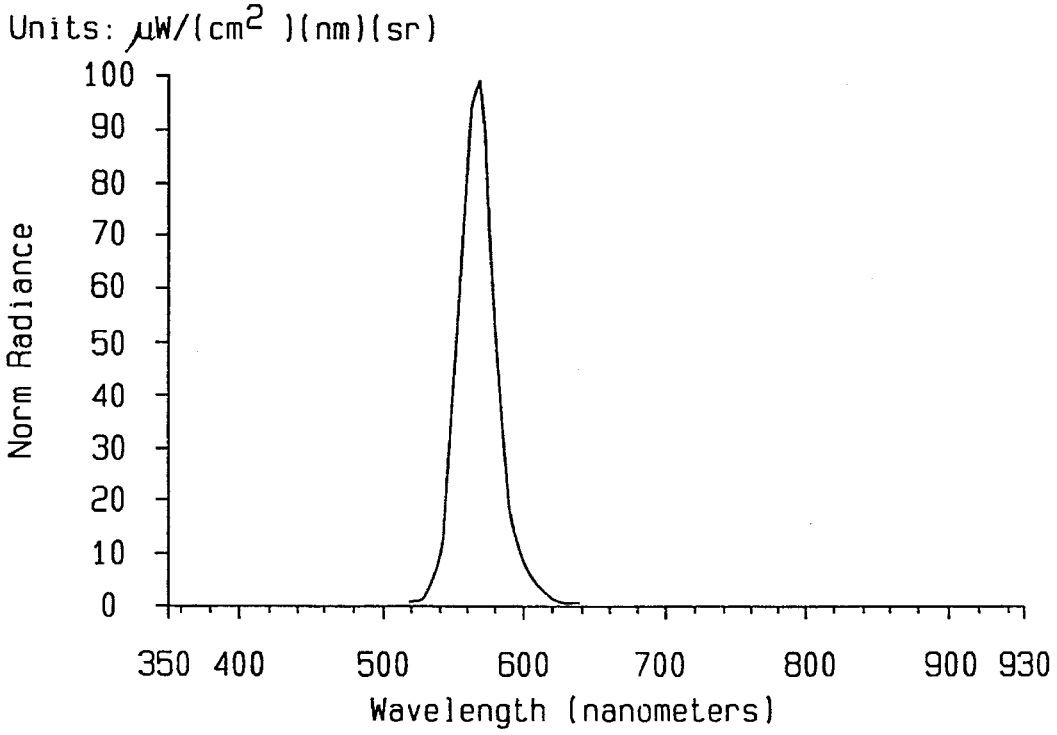
FIGS. 13–15 are normalized plots of the radiance output of the light indicator of FIG. 1 having green, yellow and red LEDs, respectively.
Figure 14:
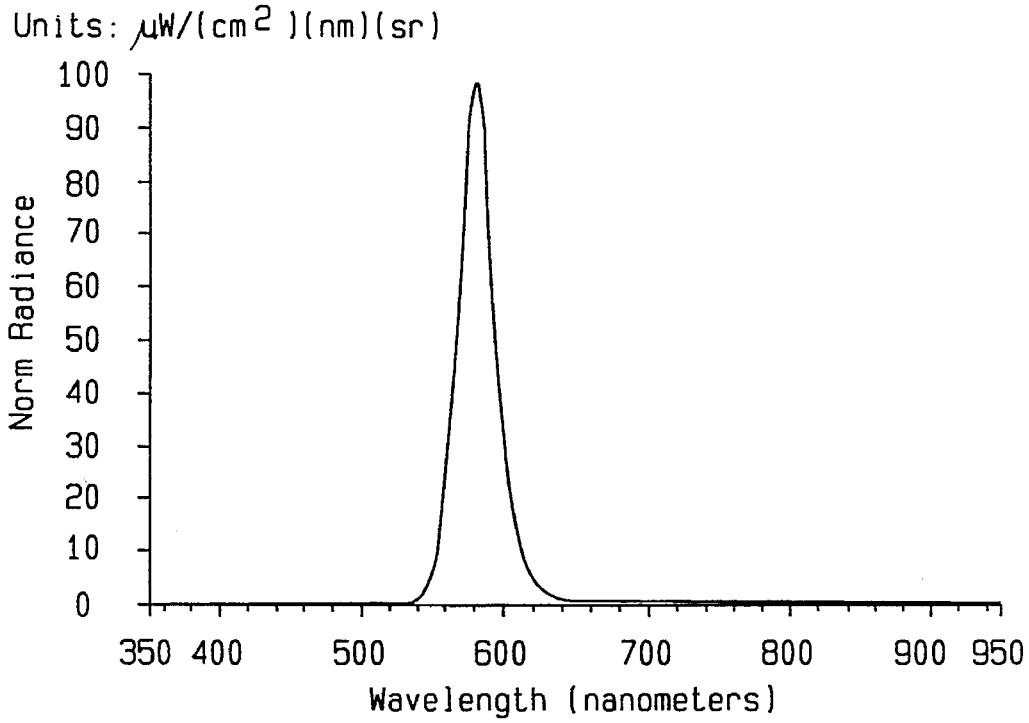
Figure 15:
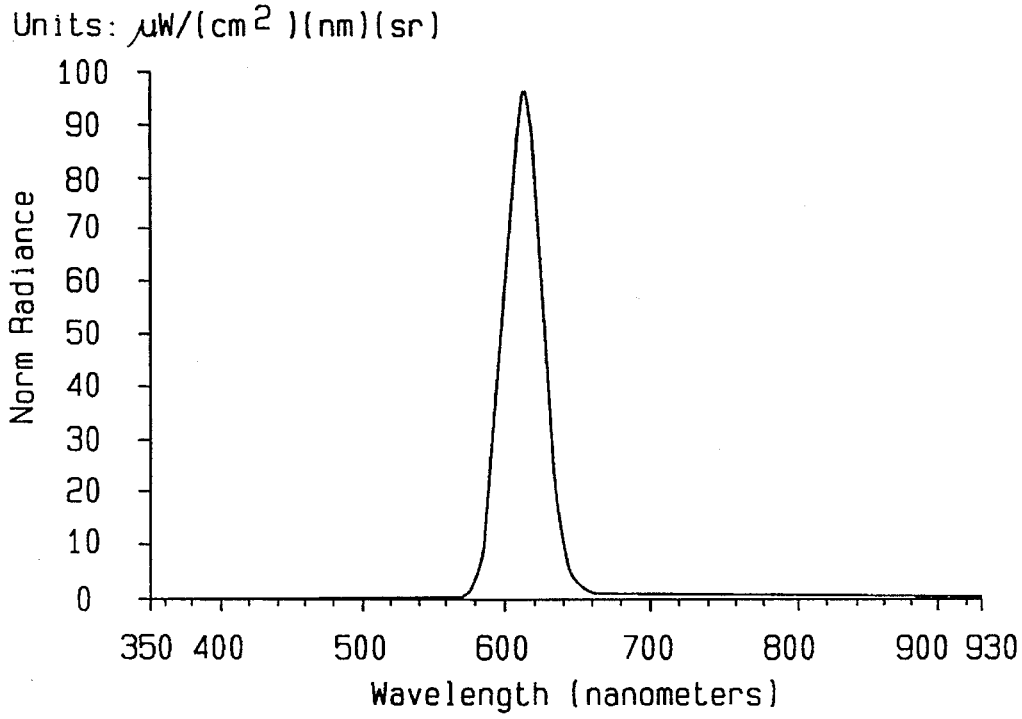

FIG. 13 is a typical normalized plot of the radiance output of light indicator 100 where the indicator has been equipped with a green LED and the polarizers are in a fully parallel position. FIG. 14 is the same plot with a yellow base LED and FIG. 15 represents a red base LED. Comparison of these figures with FIGS. 4–6 above, which represent the output of the unmodified base LED, graphically illustrates how the present invention reduces the infrared signature of light indicator 100, thereby reducing the likelihood of detection by image intensifying devices.

Figure 16:
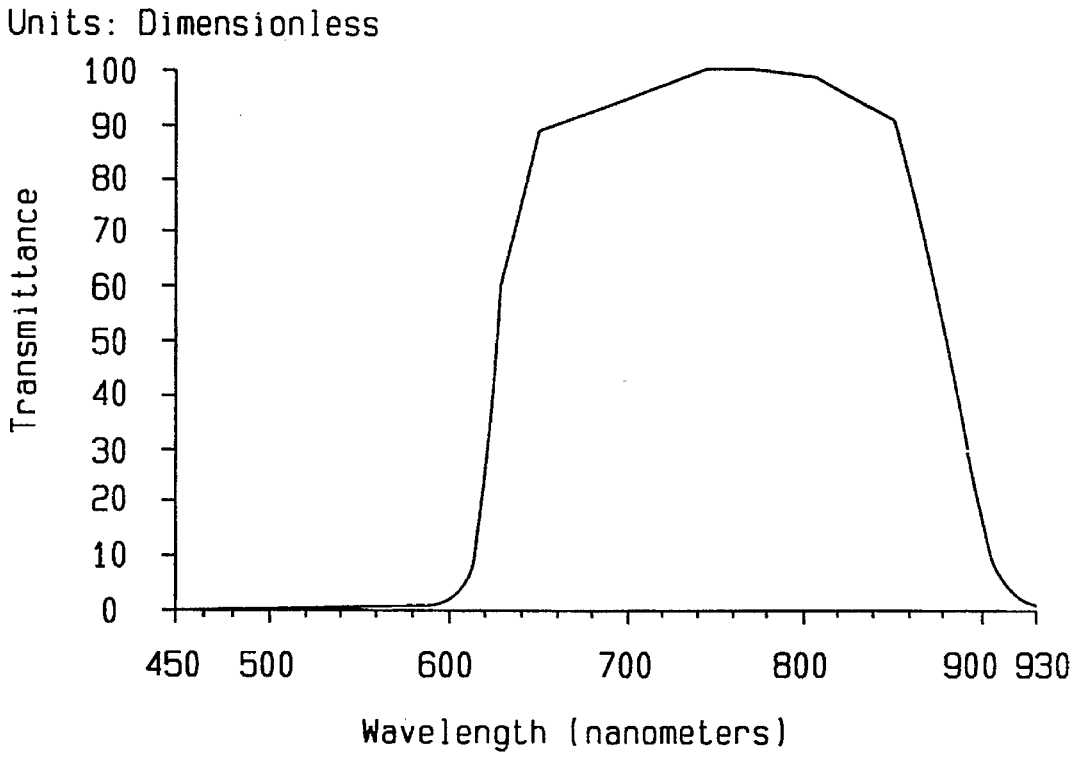
FIG. 16 is a normalized plot of the typical response of a Class A Generation III image intensifying night vision device.

This aspect is more particularly illustrated by referring to FIG. 16, a normalized plot of the typical response of a Class A Generation III image intensifying night vision device. Comparison of this figure with FIGS. 4–6 above graphically illustrates the effectiveness of the present invention in substantially reducing the possibility of a hostile entity detecting the indicator when using such night vision devices. A red base LED 200 will present some energy in the night vision band, but comparison with FIG. 6 showing the output of an unmodified red LED 200 reveals how the present invention minimizes the detection threat.

It is understood that various modifications will be readily apparent to those skilled in the art without departing from the scope and spirit of the invention. For example, it will be recognized that the usefulness of the present invention is not restricted to covert situations. Accordingly, it is not intended that the scope of the claims appended hereto be limited to the description set forth herein, but rather that the claims be construed as encompassing all features of patentable novelty that reside in the present invention, including all features that would be treated as equivalents thereof by those skilled in the art to which this invention pertains.

I claim:

1. A light indicator for use in a panel display of an equipment comprising:

means responsive to said equipment for generating light radiation as a visual indication of system information;

first and second polarization means for polarizing incident light radiation from said means for generating light radiation, said first and second polarization means arranged such that said second polarization means is selectively rotatable with respect to said first polarization means for correspondingly limiting the intensity of the light radiation from said means for generating light radiation; and filter means coupled optically to said first and second polarization means for substantially eliminating infrared radiation incident thereon from said means for generating light radiation.

2. The light indicator of claim 1 further comprising hood means for limiting the field of view of said means for generating light radiation.

3. The light indicator of claim 1 wherein said means for generating light radiation includes a light emitting diode.

4. The light indicator of claim 1 wherein said first and second polarization means include first and second circular polarizers, respectively.

5. The light indicator of claim 1 wherein said filter means includes an infrared absorbing filter.

6. The light indicator of claim 5 wherein said infrared absorbing filter is coated on one surface with an anti-reflective coating.

7. The light indicator of claim 1 further including a housing containing said means for generating light, said first and second polarization means, and said filter means.

8. The light indicator of claim 7 wherein said housing includes a rotating segment for housing said second polarization means.

9. A light indicator for providing visual indication of system information from an electronic instrument, said light indicator comprising:

a light source responsive to said electronic instrument for generating light radiation indicative of said system information;

first and second polarizers arranged such that they are selectively rotatable with respect to each other for variably reducing the transmission of said light radiation from said light source; and a filter optically coupled to said first and second polarizers such that light radiation in the infrared spectrum from said light source is substantially reduced.

10. The light indicator of claim 9 further including a housing, said light source, said first and second polarizers and said filter being mounted in said housing.

11. The light indicator of claim 10 wherein said housing includes a selectively rotatable segment, said second polarizer being mounted within said selectively rotatable segment so as to rotate said second polarizer with respect to said first polarizer.

12. The light indicator of claim 9 wherein said first and said second polarizers are circular polarizers, each of said circular polarizers having a linear polarizer and a quarter wave plate.

13. The light indicator of claim 12 wherein said first and second polarizers are arranged such that their linear polarizers are facing each other.

14. The light indicator of claim 9 wherein said filter is an infrared absorbing filter.

15. The light indicator of claim 9 further comprising a hood disposed in front of said light source for limiting the field of view of the light radiation from said light source.

16. The light indicator of claim 9 wherein said light source is a light emitting diode.

17. An electronic instrument having a light indicator for providing visual indication of system information, wherein the improvement comprises:

a housing including a selectively rotatable segment and a hood;

a light source responsive to said electronic instrument for generating light radiation indicative of said system information mounted in said housing, said hood extending away from said light source so as to limit the divergence of said light radiation from said light source;

first and second polarizers mounted in said housing and optically coupled to said light source, said second polarizer mounted in said selectively rotatable segment so as to be selectively rotatable with respect to said first polarizer, said first and second polarizers having a variable transmissivity dependent on the rotational orientation between said first and second polarizers; and an infrared absorbing filter optically coupled to said light source so as to substantially limit the light radiation from said light source to visible spectrum.

18. The electronic instrument of claim 17 wherein said first and second polarizers are circular polarizers, each of said circular polarizers having a linear polarizer and a quarter wave plate.

19. The electronic instrument of claim 18 wherein said first and second polarizers are arranged such that their linear polarizers are facing each other.

20. The electronic instrument of claim 17 wherein said light source is a light emitting diode.

* * * * *